US009765472B2

(12) United States Patent
Uchikoshi

(10) Patent No.: US 9,765,472 B2
(45) Date of Patent: Sep. 19, 2017

(54) COVER FOR IRON OF THE TROUSER-PRESSING MACHINE

(71) Applicant: SANKOSYA & #12288;Co., Ltd., Tokyo (JP)

(72) Inventor: Mitsuyuki Uchikoshi, Tokyo (JP)

(73) Assignee: SANKOSYA & Co., Ltd., Tokyo (JP)

( * ) Notice: Subject to any disclaimer, the term of this patent is extended or adjusted under 35 U.S.C. 154(b) by 28 days.

(21) Appl. No.: 15/090,760

(22) Filed: Apr. 5, 2016

(65) Prior Publication Data

US 2016/0298285 A1 Oct. 13, 2016

(30) Foreign Application Priority Data

Apr. 8, 2015 (JP) ..... 2015-78981

(51) Int. Cl.
*D06F 71/29* (2006.01)
*D06F 83/00* (2006.01)
*D06F 85/00* (2006.01)

(52) U.S. Cl.
CPC ..... *D06F 71/29* (2013.01); *D06F 83/00* (2013.01); *D06F 85/00* (2013.01)

(58) Field of Classification Search
CPC ..... D06F 71/16; D06F 71/28; D06F 71/29; D06F 71/295; D06F 71/30; D06F 71/36; D06F 81/14; D06F 83/00; D06F 85/00
USPC ..... D32/66
See application file for complete search history.

(56) References Cited

U.S. PATENT DOCUMENTS 2,473,906 A * 6/1949 Rich ..... D06F 83/00 38/66
3,305,956 A * 2/1967 Gottfried ..... D06F 71/29 223/74
3,484,965 A * 12/1969 Filho ..... D06F 71/00 38/15
3,568,900 A * 3/1971 Paris ..... D06F 73/00 223/70
3,722,115 A * 3/1973 Hanson ..... D06F 71/29 38/21
5,711,097 A * 1/1998 Mino ..... D06F 71/29 223/73
2003/0136035 A1* 7/2003 Lehrman ..... D06F 83/00 38/140
2003/0226864 A1* 12/2003 Hickle ..... D06F 71/285 223/57
2006/0143954 A1* 7/2006 Cevenini ..... D06F 83/00 38/140

(Continued)

FOREIGN PATENT DOCUMENTS

GB 780660 A * 8/1957

*Primary Examiner* — Ismael Izaguirre
(74) *Attorney, Agent, or Firm* — Michael J. Feigin, Esq.; Feigin & Fridman

(57) ABSTRACT

An upper iron and a lower iron of a trouser-pressing machine. The trouser-pressing machine has an upper iron, a lower iron and a middle iron, and forms can be press both legs of a trouser at a time. In the covers of the present invention, inside peripheral parts of main parts of covers are formed non-porously corresponding to pressing surfaces of the upper iron and the lower iron. In the present invention, the part formed non-porously can be not only the entire inside peripheral parts but also the portions corresponding to one side end of the middle iron on which the crotch of the trouser is set.

6 Claims, 4 Drawing Sheets

(56) References Cited

U.S. PATENT DOCUMENTS

2010/0186268 A1* 7/2010 Sunder ..... A47L 25/08
38/144

* cited by examiner

COVER FOR IRON OF THE TROUSER-PRESSING MACHINE

BACKGROUND OF THE INVENTION (1) Field of the invention

The present invention relates to a trouser-pressing machine is provided a middle iron between an upper iron and a lower iron. More particularly, the present invention relates to covers are used for covering over the upper iron and the lower iron.

(2) Description of the related art

In the prior art, as this type of trouser-pressing machine, there has been provided a machine descried in U.S. Pat. No. 3,425,141, for example. This prior art trouser-pressing machine is provided the middle iron that is used for setting a trouser on and is located between the upper iron and the lower iron.

The trouser setting that one trouser leg is set between the lower iron and the middle iron, the other trouser leg is set between the upper iron and the middle iron, and both trouser legs are pressed at a time by the upper iron, the middle iron, and the lower iron.

In according to the prior art machine, pressing surfaces of the upper iron and the lower iron has been formed that possible to eject steam for can be smooth wrinkle on the trouser legs by steaming.

Then, previously, covers have been formed all over well-porously are used for the upper iron and the lower iron of this type of the prior art machine.

Therefore, the steam ejects from the pressing surfaces of the upper iron and the lower iron prone to reach into a crotch and an upper crotch of the trouser.

At a result, when use the prior art machine, it has showed a problem that the trouser can not be clean up because the crotch and the upper crotch of the trouser have been wrinkled by steaming.

Thus, the prior art machine has showed a problem that extra quantity of steam increases and a steaming time takes longer because it has been steamed, in such a way, not only the part of the trouser legs but also the portion of the crotch.

Previously, the lower iron of this type of the prior art machine, usually its inner part has been exhausted when the trouser is set, so that both legs of trouser are sucked to the pressing surface (the upper surface) of the lower iron. In the case, the entire pressing surface (the upper surface) of the lower iron became sucking surface not only necessary part of sucking the trouser because all over the cover has been formed well-porously described above.

Accordingly, it has showed a problem when use the prior art cover that a suction area of the lower iron has been become large so needs to more large suction force.

In view of the problems of the prior art described above, the present invention has been provided.

Accordingly, a technical theme to solved by the present invention to provide the cover that can clean up the trouser to prevent wrinkling on the crotch of the trouser by steam ejecting from the pressing surfaces of the upper iron and the lower iron. The another theme of the present invention to provide the cover that can contribute to reduce the quantity of steam and the steaming time and to increase a suction efficiency of the lower iron.

SUMMARY OF THE INVENTION

As shown in FIG. 1, FIG. 2 and the like, the present invention is the covers are used for the upper iron and the lower iron of the trouser-pressing machine. The trouser-pressing machine using this type of the covers has been provided the middle iron between the upper iron and lower iron. This type of the trouser-pressing machine has been formed that one leg of the trouser is set between the lower iron and the middle iron, the other leg of the trouser is set between the upper iron and the middle iron, and both trouser legs are pressed at a time by the upper iron, the middle iron and the lower iron.

The covers of the present invention are formed non-porously at inside peripheral parts of the main parts of covers corresponding to pressing surfaces of the upper iron and the lower iron. The pressing surfaces of the upper iron and the lower iron mean that a lower surface of the upper iron and an upper surface of the lower iron.

In this case of the present invention, a non-porous character of the inside peripheral parts to be realize that non-porous clothes are sewed overlapping or non-porous coatings of a resinous agent are formed on the wrong side of each cover corresponding to the inside peripheral parts. A coating formation is achieved to overlay or to coat the resinous agent.

In according to another constituent of the present invention, only a portion is formed non-porously corresponding to one side end of the middle iron on which a crotch of the trouser is set at the inside peripheral part of the main part of cover. In this case, a manner of non-porous formation is the same as the coating formation.

In addition, the non-porous cloth sewing work can do together with the cover sewing work at the same time so that the cover can be processed easily with speed.

The cover of the present invention formed like this so it is possible to prevent steaming the crotch and the upper crotch of the trouser when the trouser is pressed.

Therefore, accordingly the above described, it prevents wrinkling the crotch and the upper crotch of the trouser and the trouser can be clean up.

In the case of the present invention, it is possible to restrain the extra steam by the non-porous part.

Therefore, accordingly the above described, it is possible expect to decrease the quantity of the steam and to shorten the steaming time.

In the present invention, it is possible to narrow a suction area of the lower iron because of the non-porous part is formed.

Therefore, accordingly the above described, it is possible to suck the trouser legs effectively by the small suction force.

REFERENCE TO DRAWINGS

DESCRIPTION OF PREFERABLE EMBODIMENT

Referring now to the accompanying drawings, one preferred embodiment of the present invention will be describe as follows.

Figure 2:
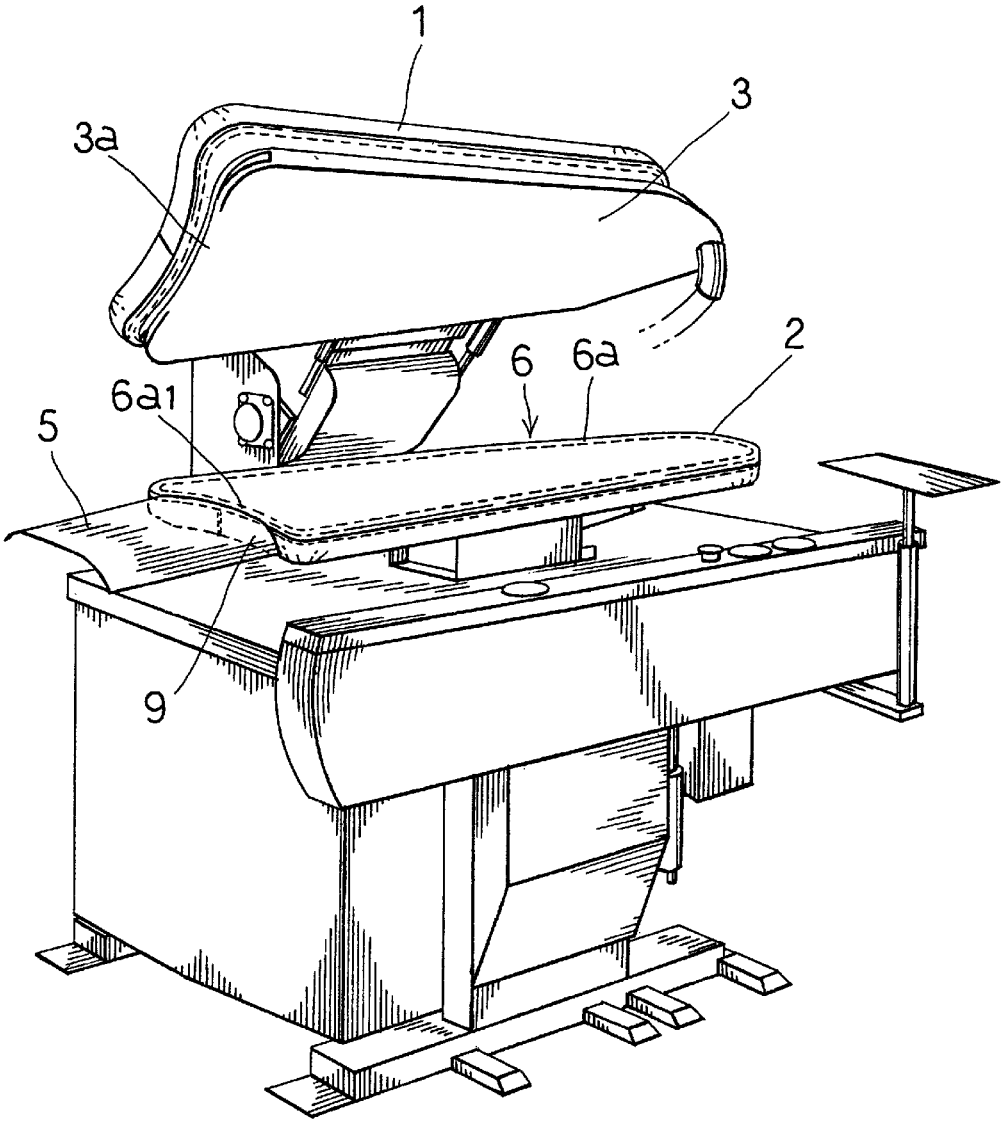
FIG. 2 is a prospective view of the trouser-pressing machine.

The present invention is covers are used for covering over an upper iron 1 and a lower iron 2 of a trouser-pressing machine. As shown in FIG. 2, the trouser-pressing machine is provided the upper iron 1, the lower iron 2 and a middle iron 3 that is located between the upper iron 1 and the lower iron 2.

As shown in FIG. 1 and the like, a trouser 4 setting that one leg 4*a* is set between the lower iron 2 and the middle iron 3, the other leg 4*b* is set between the upper iron 1 and the middle iron 3. Then, with both trouser legs 4*a*, 4*b* are held by the upper iron 1 and the lower iron 2 through the middle iron 3, are pressed at a time by pressing the upper iron 1 against the lower iron 2 with the middle iron 3. A word number 5 (refer to FIG. 2 and FIG. 6) is a stand for supporting an upper crotch 4*c* of the trouser 4.

The upper iron 1 and the lower iron 2 are formed it possible to steam up both legs 4*a*, 4*b* of the trouser 4 by steam supplying from outside. The lower iron 2 is formed that can be suck one leg 4*a* of the trouser 4 by a sucking machine (not shown). In addition, the middle iron 3 is formed that its upper surface and lower surface can be suck both legs 4*a*, 4*b* of the trouser 4 on by a sucking machine.

As shown in FIG. 1, each cover of the present invention is formed non-porously at an inside peripheral part 6*a* of a main part of cover 6 corresponding to the pressing surfaces of the upper iron 1 and the lower iron 2.

Figure 3:
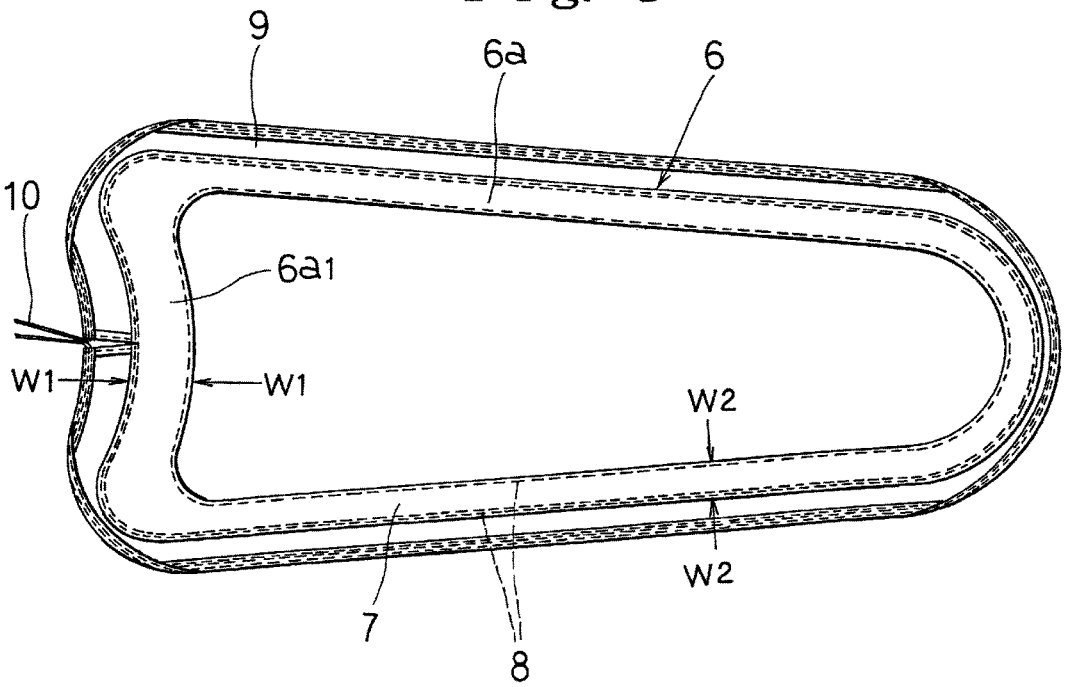
FIG. 3 is a bottom view of opening state of the cover.
Figure 5:
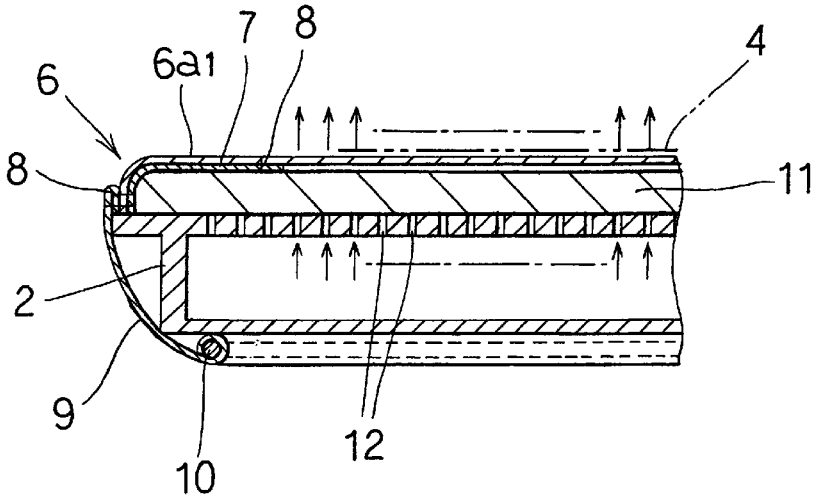
FIG. 5 is a main part enlargement cross sectional view of the line V-V in FIG. 4.

In the case of the embodiment, as shown in FIG. 3 and FIG. 5, a non-porous character of the inside peripheral part 6*a* to be realizes that a non-porous cloth 7 as the strip is provided at a portion of wrong side of cover corresponding to the inside peripheral part 6*a*. To explain more concretely, the non-porous cloth 7 is sewed overlapping on the wrong side of cover. Word numbers 8 are seams.

Figure 1A:
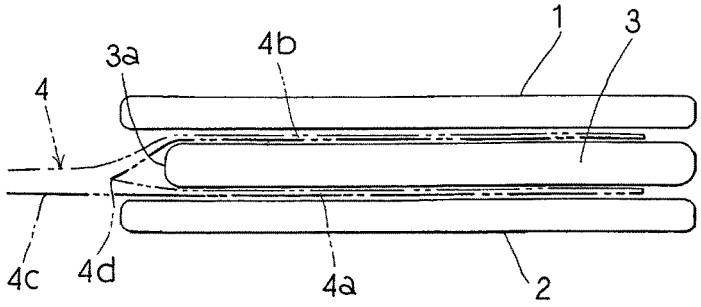
FIG. 1A is a main part side view of the relationship among the upper iron, the middle iron and the lower iron.
Figure 1B:
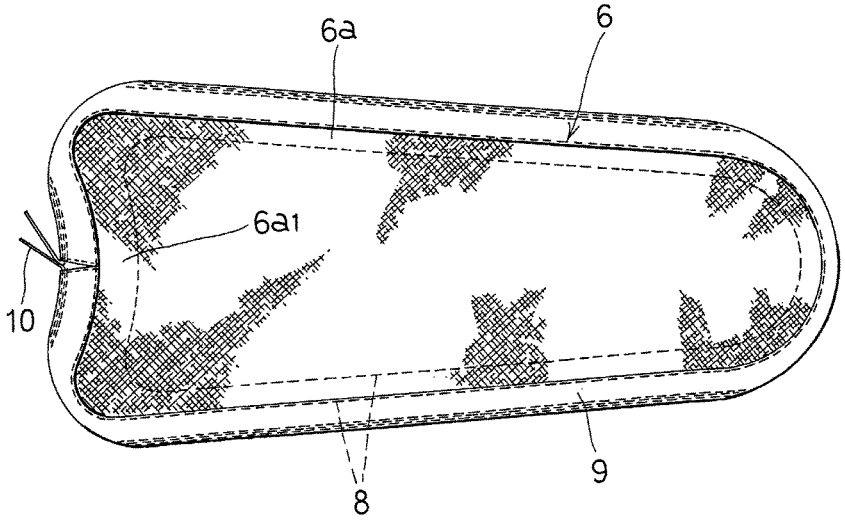
FIG. 1B is a flat view of opening state of the cover.

In according to the cover of the present invention, as shown in FIG. 1B, FIG. 3 and the like, an outside peripheral part 9 is formed around the main part of each cover 6 corresponding to the pressing surfaces of the upper iron 1 and the lower iron 2. The outside peripheral part 9 is sewed together the main part of cover 6. As shown in FIG. 5, a peripheral edge of the outside peripheral part 9 is folded down and stitches up as tube, and a strap 10 is threaded through the outside peripheral part 9.

Further, as shown in FIG. 5, a mat 11 is laid on the pressing surface of the lower iron 2. The mat 11 is laid also on the pressing surface of the upper iron 1. A steam vent 12 is many formed all over the pressing surfaces of the upper iron 1 and the lower iron 2.

Figure 6:
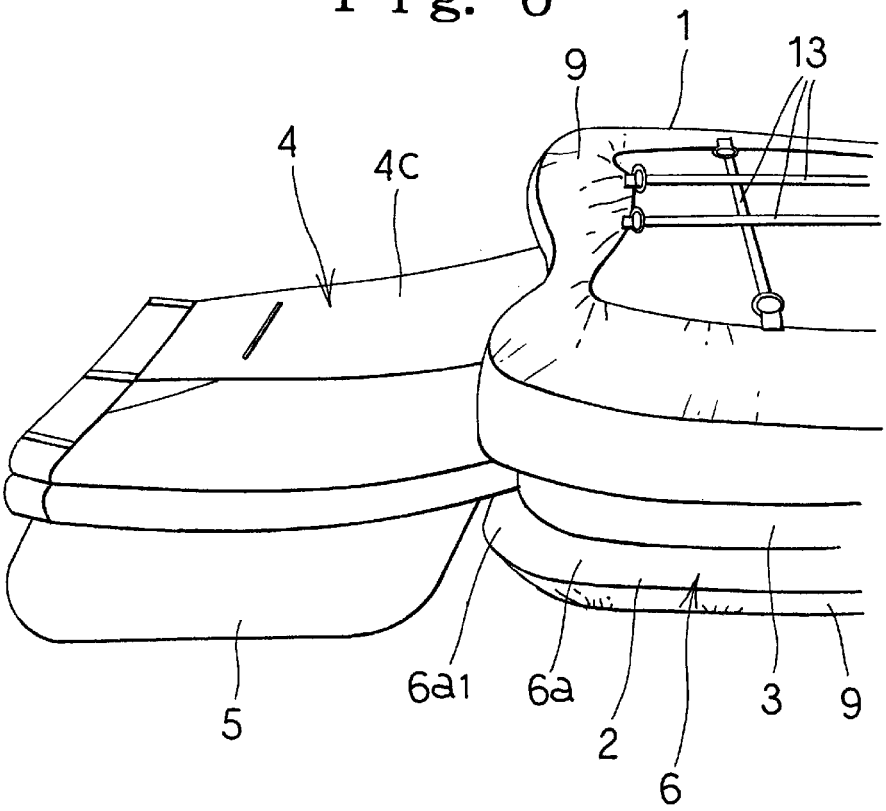
FIG. 6 is a main part prospective view of the trouser-pressing machine.

Further, as shown in FIG. 6, word numbers 13 are expansion and contraction bands for tensing the cover.

It is described that the usage example of the present invention follows.

The covers of the present invention are covered over the upper iron 1 and the lower iron 2, are fitted by the straps 10 are bind tightly. In this case, the operator lay the expansion and contraction bands 13 across the outside peripheral part 9 and tense them for do not wrinkle on the main part of cover 6.

At the time of the pressing operation of the trouser 4, as shown FIG. 1A and FIG. 6, first, the operator sets one leg 4*a* of the trouser 4 on the upper surface of the lower iron 2. Next, the operator shifts the middle iron 3 down and sets the other leg 4*b* of the trouser 4 on the upper surface of the middle iron 3. In this case, both legs 4*a*, 4*b* are sucked to the upper surface of the lower iron 2 and the upper and lower surfaces of the middle iron 3 for do not move unexpectedly.

Next, the upper iron 1 is pressed against the lower iron 2 with the middle iron 3 only for a predetermined time.

In the same time, both legs 4*a*, 4*b* of the trouser 4 are steamed by steam ejecting from insides of the upper iron 1 and the lower iron 2 (refer to the allow of FIG. 5).

In this case, the covers of the present invention, refer to the above description, each inside peripheral part 6*a* of each main part of cover 6 is formed non-porously.

Therefore, accordingly the covers of the present invention, the steam does not eject from each inside peripheral part 6*a* of each main part of cover 6 including each portion 6*a*1 corresponding to one side end 3*a* of the middle iron 3 on which the crotch 4*d* of the trouser 4 is set.

So, the portions of the crotch 4*d* and the upper crotch 4*c* of the trouser 4 do not steam. As a result, it is possible to prevent wrinkling on the crotch 4*d* and the upper crotch 4*c* of the trouser 4 when use the covers of the present invention.

With the arrangement as above, the entire inside peripheral part 6*a* of the main part of cover 6 is formed non-porously the above example, but the present invention is not limited above case. That is, the present invention may also be applicable that only the portion 6*a*1 can be form non-porously corresponding to one side end 3*a* of the middle iron 3 on which the crotch 4*d* of the trouser 4 is set at the inside peripheral part 6*a*.

In accordance to the present invention, the manner of non-porous formation is not limited to the above example. For example as the another manner, a manner of non-porous coating forms that the resinous agent is overlaid or is coated.

Figure 4:
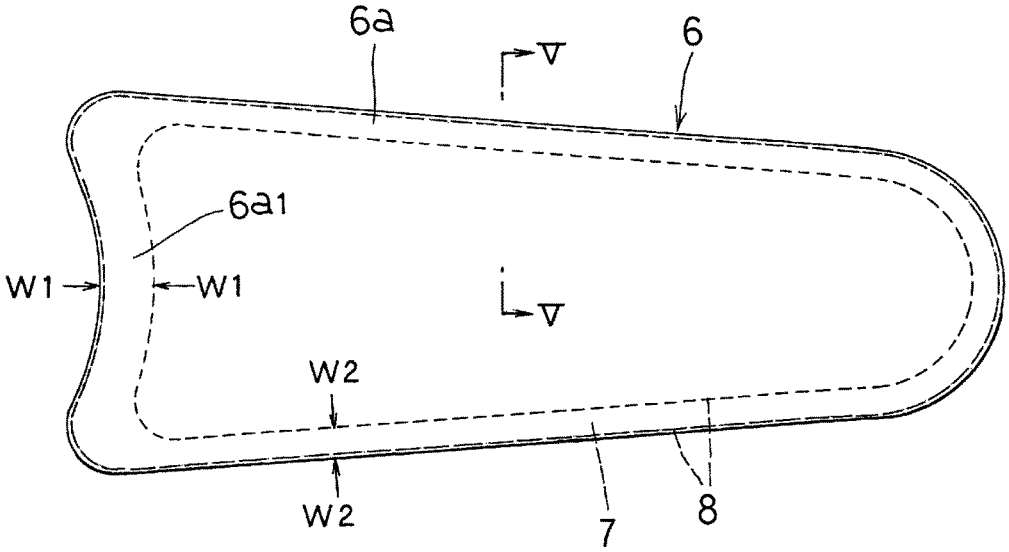
FIG. 4 is a flat view of using state of the cover.

As shown in FIG. 3 and FIG. 4, the cover of the present invention may also be applicable that the width W1 of the portion 6*a*1 can be formed larger then the other width W2 of the inside peripheral part 6*a*. Because, in the case, it is possible to surely prevent steaming the crotch 4*d* of the trouser 4.

The invention claimed is:

1. Covers are used for an upper iron and a lower iron of a trouser-pressing machine as a type in which a middle iron is provided between the upper iron and the lower iron, one leg of a trouser is set between the lower iron and the middle iron, the other leg of the trouser is set between the upper iron and the middle iron, both trouser legs are held by the upper iron, the middle iron and the lower iron and are pressed at a time characterized in that inside peripheral parts of main parts of covers corresponding to pressing surfaces of the upper iron and the lower iron are formed non-porously.

2. The covers are used for the irons of the trouser-pressing machine according to claim 1 characterized in that non-porous clothes are sewed overlapping on portions of the wrong side of the covers corresponding to the inside peripheral parts.

3. The covers are used for the irons of the trouser-pressing machine according to claim 1 characterized in that non-porous coatings made of a resinous agent are formed on the portions of the wrong side of the covers corresponding to the inside peripheral parts.

4. The covers are used for the upper iron and the lower iron of the trouser-pressing machine as a type in which the middle iron is provided between the upper iron and the lower iron, one leg of the trouser is set between the lower iron and the middle iron, the other leg of the trouser is set between the upper iron and the middle iron, both trouser legs are held by the upper iron, the middle iron and the lower iron and are pressed at a time characterized in that portions are only formed non-porously corresponding to one side end of the middle iron on which a crotch of the trouser is set at the inside peripheral parts of the main part of covers corresponding to the pressing surfaces of the upper iron and the lower iron.

5. The covers are used for the irons of the trouser-pressing machine according to claim 4 characterized in that the non-porous clothes are sewed overlapping on only the portions corresponding to one side end of the middle iron on which the crotch of the trouser is set at the inside peripheral parts of the wrong side of the covers.

6. The covers are used for the irons of the trouser-pressing machine according to claim 4 characterized in that the non-porous coatings of the resinous agent are formed on only the portion corresponding to one side end of the middle iron on which the crotch of the trouser is set at the inside peripheral parts of the wrong side of the covers.

* * * * *